US005897013A

United States Patent [19]

Manganiello

[11] Patent Number: 5,897,013

[45] Date of Patent: Apr. 27, 1999

[54] STRAW FOR DRINKING CUP

[75] Inventor: Francis X. Manganiello, Pompton Plains, N.J.

[73] Assignee: Playtex Products, Inc., Westport, Conn.

[21] Appl. No.: 08/834,074

[22] Filed: Apr. 14, 1997

[51] Int. Cl.[6] ..... B65D 47/08

[52] U.S. Cl. ..... 220/252; 220/254; 220/709; 215/229; 215/388; 222/528; 239/33

[58] Field of Search ..... 220/703, 705–710, 220/717, 252, 256, 259, 345, 351, 254; 215/387, 388, 229, 322; 222/528, 529, 530, 464.1; 239/33; 224/148.2

[56] References Cited

U.S. PATENT DOCUMENTS

| | | | |
|---|---|---|---|
| D. 366,809 | 2/1996 | Green . | |
| 2,432,132 | 12/1947 | Allen . | |
| 2,716,511 | 8/1955 | Leathers . | |
| 2,724,536 | 11/1955 | Pugh, Sr. . | |
| 2,786,606 | 3/1957 | Dushek et al. . | |
| 2,844,267 | 7/1958 | Petriccione . | |
| 2,893,613 | 7/1959 | Davis . | |
| 2,957,614 | 10/1960 | Krajcovic . | |
| 3,132,776 | 5/1964 | Wasserberg . | |
| 3,167,220 | 1/1965 | Koukal . | |
| 3,181,743 | 5/1965 | Libit et al. . | |
| 3,181,745 | 5/1965 | Grobowski . | |
| 3,294,293 | 12/1966 | Johns . | |
| 3,337,098 | 8/1967 | Johns . | |
| 3,840,153 | 10/1974 | Devlin | 215/229 X |
| 4,153,170 | 5/1979 | Aquarian . | |
| 4,228,913 | 10/1980 | Mack et al. . | |
| 4,252,256 | 2/1981 | Walsh . | |
| 4,291,814 | 9/1981 | Conn . | |
| 4,440,327 | 4/1984 | Dark . | |
| 4,485,963 | 12/1984 | Panicci . | |
| 4,494,668 | 1/1985 | Lottick . | |
| 4,660,748 | 4/1987 | Hagan . | |
| 4,684,032 | 8/1987 | Tsay . | |
| 4,699,318 | 10/1987 | Donatello et al. . | |
| 4,852,762 | 8/1989 | Chou-Sheng . | |
| 4,925,040 | 5/1990 | Wang . | |
| 4,982,854 | 1/1991 | Ichimiya . | |
| 5,039,012 | 8/1991 | Inaba | 215/388 X |
| 5,054,631 | 10/1991 | Robbins, III . | |
| 5,085,335 | 2/1992 | Carbaugh . | |
| 5,150,815 | 9/1992 | Saklad . | |
| 5,188,283 | 2/1993 | Gu . | |
| 5,201,460 | 4/1993 | Caines | 239/33 X |
| 5,203,468 | 4/1993 | Hsu . | |
| 5,203,841 | 4/1993 | Kitabayashi | 222/530 X |
| 5,259,538 | 11/1993 | Tardif | 222/530 X |
| 5,265,757 | 11/1993 | Wu . | |
| 5,273,172 | 12/1993 | Rossbach et al. . | |
| 5,282,541 | 2/1994 | Chen . | |
| 5,337,918 | 8/1994 | Wang . | |
| 5,339,982 | 8/1994 | Tardie . | |
| 5,346,081 | 9/1994 | Lin . | |
| 5,361,934 | 11/1994 | Spence, Jr. | 220/709 X |
| 5,381,924 | 1/1995 | Kiefel . | |
| 5,465,866 | 11/1995 | Belcastro . | |
| 5,497,901 | 3/1996 | Chen . | |
| 5,582,320 | 12/1996 | Lin | 220/709 X |
| 5,607,086 | 3/1997 | Gooch | 222/530 X |

FOREIGN PATENT DOCUMENTS

| | | | |
|---|---|---|---|
| 212738 | 1/1961 | Austria | 222/530 |
| 2695910 | 3/1994 | France | 220/709 |
| 3708750 | 9/1988 | Germany . | |
| 91/12755 | 9/1991 | WIPO | 239/33 |

OTHER PUBLICATIONS

"Power Bottles" brochure, Bicycling Magazine, Apr. 1995.

*Primary Examiner*—Allan N. Shoap
*Assistant Examiner*—Nathan Newhouse
*Attorney, Agent, or Firm*—Ohlandt, Greeley, Ruggiero & Perle, L.L.P.

[57] ABSTRACT

A straw assembly has a flexible first segment with at least one longitudinal glide ridge extending inwardly from a drinking end thereof, a retaining shoulder at a fixed distance from the drinking end, and an orienting finger extending from the retaining shoulder.

14 Claims, 3 Drawing Sheets

STRAW FOR DRINKING CUP

The present invention relates to a straw for use in drinking cups. More particularly, the present invention relates to a drinking straw having an orienting finger to be inserted into a mating recess in the underside of a cup lid and ridges on a portion of the upper part of the straw to facilitate insertion of the straw through a hole in the lid.

BACKGROUND OF THE INVENTION

A variety of reusable straw assemblies are known in the art for use in drinking cups. Flexible elastomeric straws made of various materials, such as silicone, have been used, as have two piece straw assemblies. The latter typically consist of a lower straw mounted on the underside of a lid and an upper straw mounted on the top of a lid, to form an integral straw assembly. Straws having various elements preventing their accidental removal from the cup, such as lips, collars on the outside of the cup lid, and the like, are also known.

Nonetheless, most of these designs are laborious and time-consuming to assemble, difficult to clean, and of limited durability.

The art has also failed to provide a straw assembly optimally suited for use in a spillproof drinking cup of the type disclosed in U.S. Pat. No. Des. 366,809 to Green or U.S. Pat. No. 5,273,172 to Rossbach et al., which are licensed to the assignee of the present invention. These cup assemblies include a cup, a threaded or snap-on lid, a hole through the lid to accept a straw, and a cap mounted on the lid and rotatable about a horizontal axis to fold, seal and enclose the protruding top of the straw.

A typical disposable plastic straw could be used in these cup assemblies. The drawbacks of such a straw are evident. The plastic would rapidly be weakened and split by the bending motion required in the sealing cap. A standard straw would have to be cut to fit the dimensions of the cup and sealing cap. Furthermore, a standard straw would tend to slip and rest directly on the bottom of the cup, limiting the suction action of the straw. In addition, the straw could be difficult to insert through the hole in the lid without bending and buckling. The sealing action of these cups also would be limited by the thin, semi-rigid walls of the straw. Only a partial seal would be effected.

SUMMARY OF THE INVENTION

Against the foregoing background, it is a primary object of the present invention to provide a straw assembly that is durable and easy to clean, and quick and easy to assemble and use.

It is a further object of the present invention to provide such a straw assembly that is safe in that component parts cannot be readily disassembled by an infant.

To the accomplishment of the foregoing objects and advantages, the present invention, in brief summary, comprises: a straw assembly having a flexible first segment and a second segment. The first segment has a first end and an opposite, drinking end. The first segment further includes a retaining shoulder at a fixed distance from the drinking end, and an orienting finger extending from the retaining shoulder. The first segment preferably also includes at least one longitudinal glide ridge extending inwardly from the drinking end.

The present invention also provides a cup assembly comprising a cup, a lid removably mounted on the cup having an aperture therethrough, a flexible straw element adapted to be inserted through the aperture from the underside of the lid, and a sealing cap mounted on the lid adjacent to the aperture. The flexible straw element includes a plurality of longitudinal glide members, a retaining shoulder adapted to arrest the movement of the straw element through the aperture when a predetermined portion of the straw element protrudes through a top side of the lid, and an orienting finger adapted to engage a single location on the underside of the lid, such that the glide members face the sealing cap when the sealing cap is in an open position.

DESCRIPTION OF THE PREFERRED EMBODIMENTS

A preferred embodiment of the present invention is designed for use in combination with the Power Bottle USA spill-proof cup, as substantially disclosed in U.S. Pat. No. 5,273,172 to Rossbach et al., and U.S. Design Pat. No. 366,809 to Green. Accordingly, these patents are incorporated herein by reference.

Figure 1:
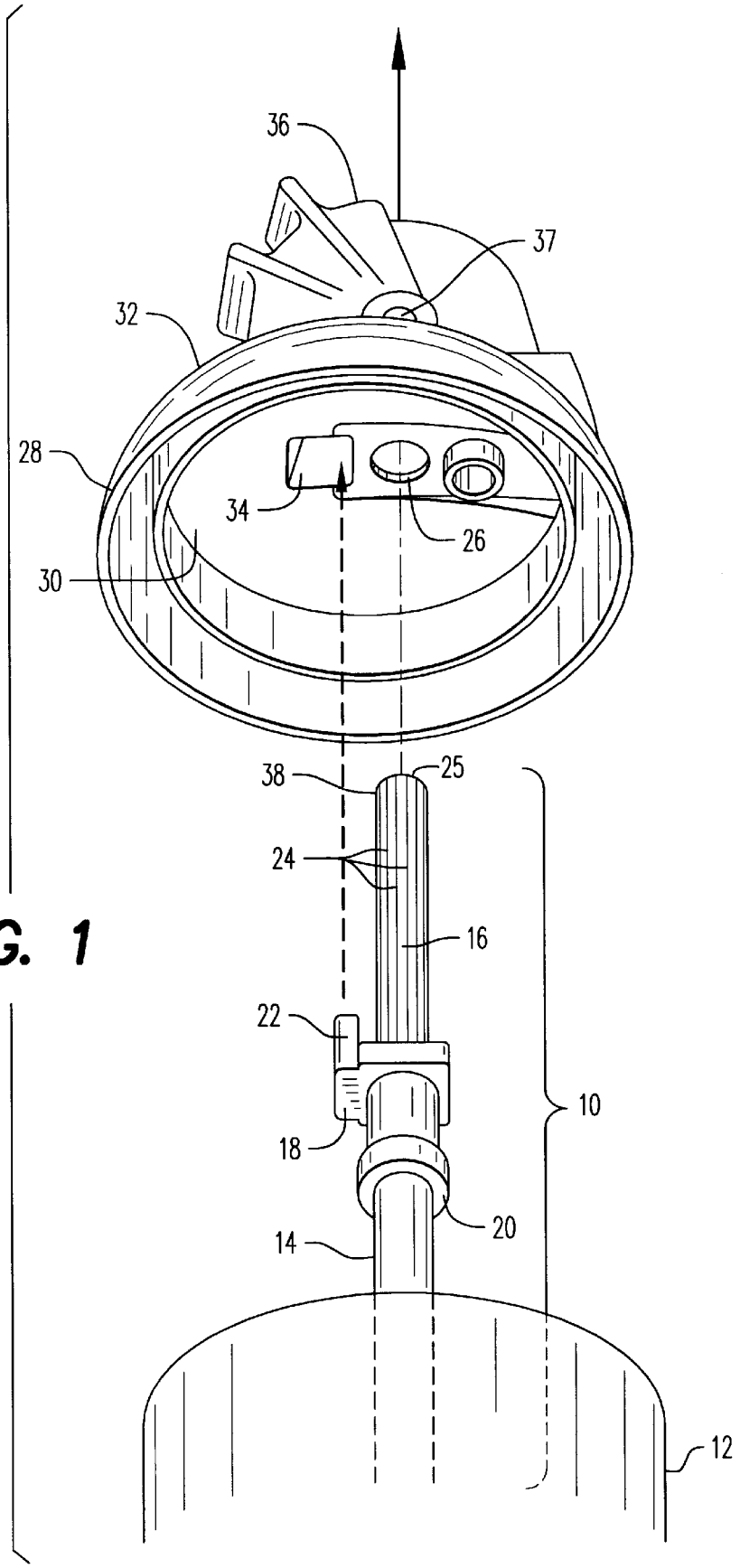
FIG. 1 is a side perspective view of a straw assembly of the present invention.
Figure 2:
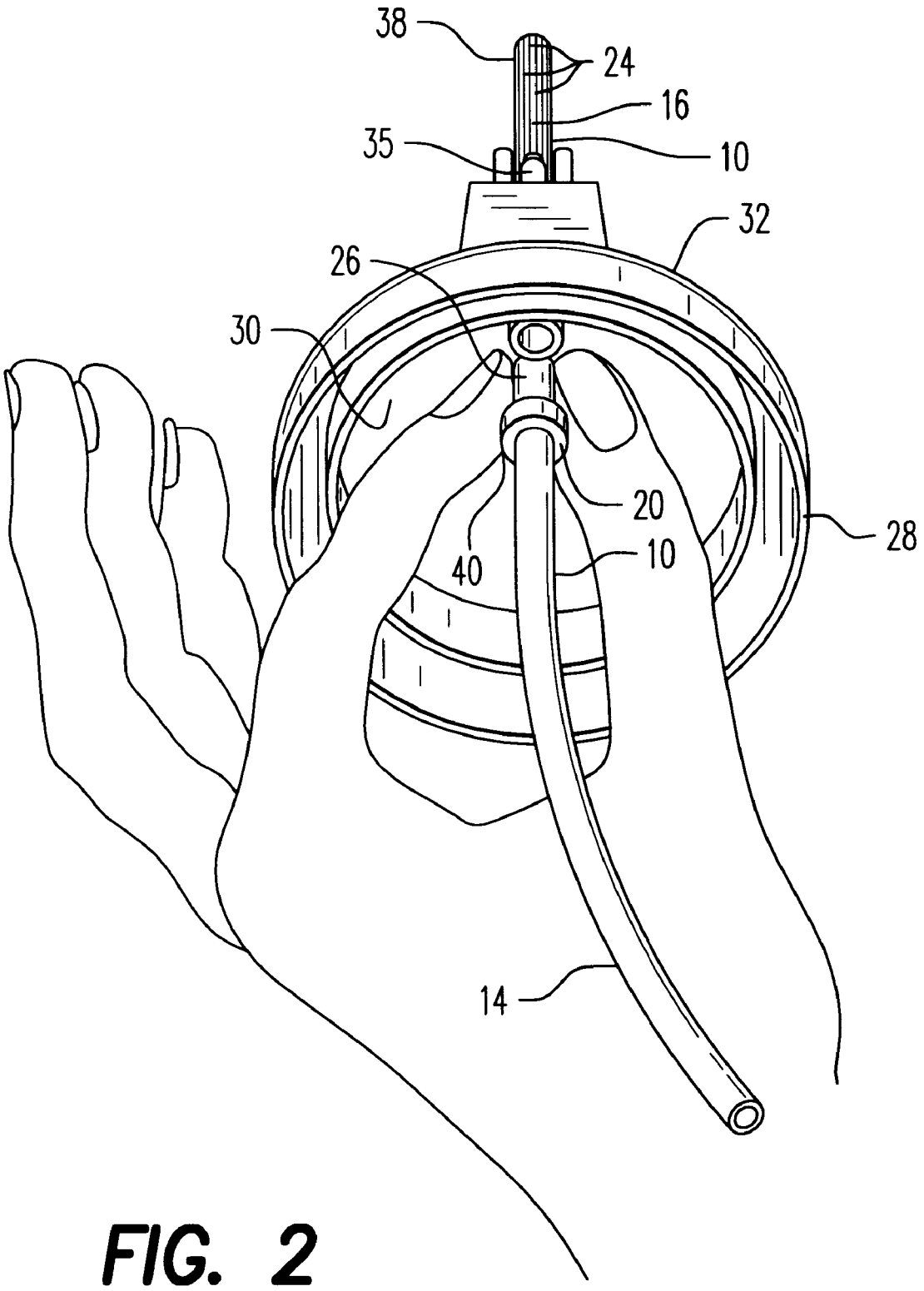
FIG. 2 is a side perspective view of the straw assembly of FIG. 1 mounted in a cup lid.
Figure 3A:
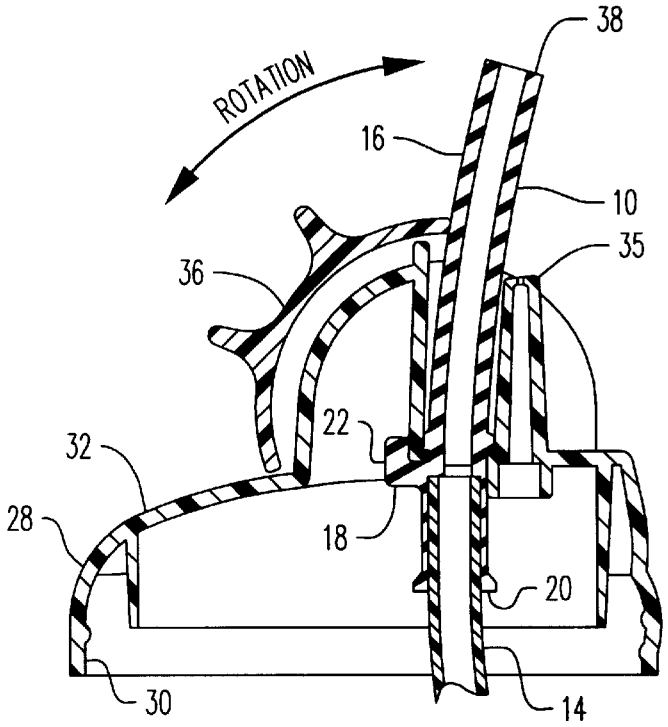
FIG. 3A is a cross-sectional representation of the assembly of FIG. 2 when the straw assembly is open for use.
Figure 3B:
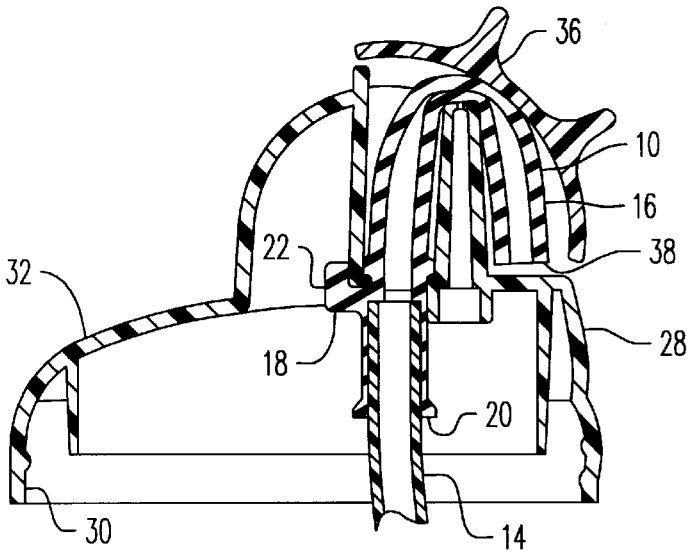
FIG. 3B is a cross-sectional representation of the assembly of FIG. 2 when the straw assembly is sealed.

Referring to the drawings and, in particular, FIGS. 1, 2 and 3, the straw or straw assembly is generally represented by reference numeral 10. The straw 10 is at east a two-piece straw adapted to be inserted in a leak-roof cup 12. The two-piece straw 10 includes an elongated lower segment 14 and an elongated, but shorter, upper segment 16. The upper segment 16 has a first or rear end 20 and a second or drinking end 38. The upper segment 16 also has a radially extending shoulder 18, preferably positioned toward the first end 20, and a finger 22 extending from the shoulder 18 and virtually perpendicular thereto. The upper segment 16 includes a plurality of longitudinal or axial ridges 24 extending along part of the outer circumferential surface of the upper segment to form a ridged surface 25.

The cup lid 28 has an inner surface 30, an outer or top surface 32, and an opening 26 through the inner and outer surfaces. The inner surface 30 also has an indentation 34. In addition, cup lid 28 includes a sealing post 35 (see FIGS. 3A and 3B).

The upper segment 16 is inserted through opening 26 in cup lid 28. The shoulder 18 of upper segment 16 is designed to stop the upper segment's forward progress when an appropriate length is protruding from outer surface 32, and to prevent the straw from being pulled through the opening. The protruding length provides sufficient exposure of straw 10 to enable a child or other user to suck easily on the straw. Preferably, the length is limited, on the other hand, to a length that can be enclosed by sealing cap 36. In this preferred embodiment, sealing cap 36 is mounted on pivots 37 situated on either side of opening 26. In an alternate preferred embodiment, sealing cap 36 is mounted to slide horizontally over the straw.

The finger 22 engages indentation 34 to further secure straw 10 and to orient the straw's ridged surface 25 properly in relation to sealing cap 36. When finger 22 is properly engaged in indentation 34, ridged surface 25 faces the open sealing cap 36. The ridges 24 facilitate the sliding of sealing cap 36 over the straw's surface, and enable the easy insertion and removal of straw 10 through opening 26.

The upper segment 16 is made of a flexible, safe material that can be cleaned. The preferred material is silicone, thermoplastic elastomer (TPE) or polyvinyl chloride (PVC). The lower segment 14, which is not placed in the child's mouth and is used to transport liquid under suction from the lower portion of the cup, is made of a more rigid material, such as, for example, polyethylene, polypropylene or PVC. The material in the upper segment 16 may be more expensive than the preferred material of the lower section 14.

The ridges 24 act as glide enhancers, to a certain extent, by preventing a total contact of straw 10 against plastic cap or lid. As discussed above, this allows straw 10 to remain stable and stationary during use, but allows it to slide easily when pushed by the sealing cap 36 to a closed position. The ridges 24 also make upper segment 16 easier to grip and insert, especially when it is wet from cleaning or exposure to the liquid to be dispensed. Preferably, ridges 24 are closely adjacent to one another. In addition, ridges 24 preferably are evenly spaced, and are located on approximately half (or a 180° arc) of the circumference of upper segment 16. If ridges 24 are disposed about the entire circumference of upper segment 16, insufficient compression or adhesion may occur between the upper segment 16 and sealing post 35 for a leakproof seal. The ridges 24 preferably extend from drinking end 38 to retaining shoulder 18.

The lower segment 14 is adapted to fit within the first end 20 of upper segment 16 to form a unitary straw assembly. As discussed above, this two-piece design allows the parts of the straw to be fabricated from different materials having different characteristics. Preferably, upper segment 16 is formed of a flexible, strong, elastomeric material such as surgical grade silicone, TPE or PVC. This allows it to be soft to drink from and easy to clean, while also enabling it to be bent and sealed repeatedly with minimal force and without cracking or ripping. Lower segment 14 can be constructed of a sturdier, stiffer material such as polyethylene, polypropylene or PVC. This facilitates the joinder of the two segments 14,16, as the stiffer lower segment can easily be inserted into the upper segment. This design also lowers the cost of manufacturing straw 10, and allows lower segment 14 to be disposable, if desired. In addition, the two-piece design makes cleaning easier, as the two pieces are shorter than a single piece unit. Accordingly, it is easier to ensure that the segments 14,16 are clean, as the center sections of each segment are less distant from the ends than in a longer straw.

Various modifications can be made to this preferred embodiment. For example, the assembly does not need to comprise two separate pieces. Two pieces of disparate materials can be molded together to form a unitary straw having most of the attributes of the preferred embodiment described above. The straw 10 can also be made entirely of silicone or other flexible material. Furthermore, the configuration of shoulder 18 and finger 22 can be varied without affecting the function they perform. In addition, if used with a cup lid having a different internal configuration, finger 22 need not be orthogonal to shoulder 18. A cup lid having a loop extending from its inner surface could accept a finger extending straight out from the end of the shoulder (in essence, the shoulder and finger are one uniform structure).

The design of ridges 24 can also be varied. The ridges 24 need not extend the entire distance from drinking end 38 to shoulder 18, but their spacing and depth can be modified. In addition, as discussed above, straw 10 of the present invention is useful in a variety of cups having various sealing means and configurations.

The invention having been thus described with particular reference to the preferred forms thereof, it will be obvious that various changes and modifications may be made therein without departing from the spirit and scope of the invention as defined in the appended claims.

What we claim is:

1. A straw assembly for use with a drinking cup, the drinking cup having an opening and having a cup lid with an aperture therethrough, said straw assembly comprising a straw having a flexible first segment with an elongated body, said elongated body having a portion that is adapted to pass through the aperture of the cup lid, said portion having a drinking end, said first segment including:

at least one longitudinal glide ridge extending outward from only part of the circumference of said elongated body;

a retaining shoulder extending outward from said first segment to an extent greater than an extent of the aperture through the cup lid but less than that of the opening of the drinking cup, said retaining shoulder being located at a fixed distance from said drinking end for preventing said straw from being pulled outward through the aperture beyond said fixed distance; and an orienting finger extending from said retaining shoulder.

2. The straw assembly of claim 1, wherein said first segment has a first end that is removed from said drinking end, said straw further comprising a second segment adapted to be joined to said first end of said first segment.

3. The straw assembly of claim 2, wherein said first segment and said second segment are made of different materials.

4. The straw assembly of claim 3, wherein said first segment is made of a flexible elastomeric material, and wherein said second segment is made of a semi-rigid material.

5. The straw of claim 1, wherein said at least one longitudinal glide ridge includes a plurality of said longitudinal glide ridges located about only 180 degrees or less of the circumference of said first segment, and said longitudinal glide ridges extend from said drinking end of said first segment to said retaining shoulder.

6. The straw assembly of claim 1, wherein said orienting finger extends orthogonally from said retaining shoulder.

7. The straw assembly of claim 1, wherein said orienting finger extends from a distal edge of said retaining shoulder, and wherein said orienting finger is adapted to engage the cup lid and orient said flexible first segment of said straw against rotation about the longitudinal axis of said straw, such that said at least one glide ridge faces a certain direction relative to the cup lid when said first segment is received in the aperture of the cup lid and said orienting finger is engaged with the cup lid.

8. The straw assembly of claim 1, wherein the cup lid has an underside with an indentation therein, and wherein said orienting finger is adapted to be received in the indentation of the cup lid.

9. The straw assembly of claim 8, wherein said orienting finger is disposed from a circumferential centerpoint of said at least one longitudinal glide ridge at an angle equivalent to the angle between said indentation and a plane of movement of a sealing cap mounted on said cup lid, to aid in properly locating said at least one longitudinal glide ridge in relation to said sealing cap.

10. A cup assembly comprising:

a cup;

a lid removably mounted on said cup having an aperture therethrough;

a flexible straw element adapted to be inserted through said aperture from an underside of said lid; and a sealing cap mounted on said lid adjacent said aperture;

wherein said flexible straw element includes a plurality of longitudinal glide members, a retaining shoulder adapted to arrest the movement of said straw element through said aperture when a predetermined portion of said straw element protrudes through a top side of said lid, and an orienting finger adapted to engage a location of said lid, such that said glide members face said sealing cap when said sealing cap is in an open position.

11. The cup assembly of claim 10, further comprising a straw segment adapted to be joined to said straw element.

12. The cup assembly of claim 10, wherein said flexible straw element and said straw segment are made of different materials.

13. The cup assembly of claim 11, wherein said flexible straw element is made of a flexible elastomeric material, and wherein said straw segment is made of a semi-rigid material.

14. The cup assembly of claim 10, wherein the underside of the lid has an indentation therein, and wherein said orienting finger extends upward from said retaining shoulder and is adapted to be received in the indentation in the lid, to rotationally orient said flexible straw element into a fixed position relative to the longitudinal axis of said straw element and to the lid.

* * * * *